US005329642A

United States Patent [19]

Dampney

[11] Patent Number: 5,329,642

[45] Date of Patent: Jul. 19, 1994

[54] HELMETS

[75] Inventor: Ian Dampney, London, United Kingdom

[73] Assignee: Helmets Limited, Herts, United Kingdom

[21] Appl. No.: 950,894

[22] Filed: Sep. 25, 1992

[30] Foreign Application Priority Data

Sep. 25, 1991 [GB] United Kingdom ..... 9120363

[51] Int. Cl.[5] ..... A42B 3/00

[52] U.S. Cl. ..... 2/424; 2/6.5; 2/6.4

[58] Field of Search ..... 2/424, 425, 410, 10, 2/6, 9, 6.3, 6.4, 6.5, 6.7, 422

[56] References Cited

U.S. PATENT DOCUMENTS

| | | | |
|---|---|---|---|
| 3,383,706 | 5/1968 | Lobelle | 2/6 |
| 4,199,823 | 4/1980 | Jenkins et al. | 2/424 |
| 4,292,688 | 10/1981 | Ellis | 2/6 |
| 4,571,747 | 2/1986 | Briggs | 2/424 |
| 4,621,377 | 11/1986 | Pennell | 2/6 |
| 4,907,300 | 3/1990 | Dampney et al. | 2/424 |

*Primary Examiner*—Peter Nerbun
*Assistant Examiner*—Michael A. Neas
*Attorney, Agent, or Firm*—Birch, Stewart, Kolasch & Birch

[57] ABSTRACT

A helmet having a visor mounted on pivot posts fixed to the helmet shell includes a visor driving and latching mechanism which acts both to allow the wearer to move the visor between its lowered and raised positions and also to hold the visor in either position. The mechanism has an operating lever which is pivoted to the visor at a point spaced from the pivot post. The operating lever has a slightly elongated aperture which receives the pivot post, and a hollowed out portion which receives a cam fixed relative to the pivot post. The operating lever has a first tooth which engages a first recess in the cam to hold the visor in its lowered position, and a second tooth which engages in a second recess in the cam to hold the visor in its raised position. To move the visor from its lowered to its raised position, the wearer manually rotates the operating lever in the appropriate direction. Initial rotation of the operating lever about its pivotal connection to the visor withdraws the first tooth from the first recess to release the visor. Further rotation of the operating lever rotates the visor about the pivot post until the second tooth reaches the second recess, whereupon the operating lever rotates about its pivotal connection to the visor so as to move the second tooth into the second recess to latch the visor in the raised position.

12 Claims, 3 Drawing Sheets

R.H. LEVER

L.H. LEVER

HELMETS

BACKGROUND OF THE INVENTION

This invention relates to helmets and more particularly helmets having visors pivotably mounted thereon.

Certain helmets, for example aircrew helmets, are fitted with two visors. In an aircrew helmet it is often necessary to quickly move one or both of the visors from a retracted position to an operative position and to lock the visor in the required position. To facilitate this, lever mechanisms have been proposed.

For example, EP 0 270 368 discloses a visor mechanism which automatically locks the visor in a raised or lowered position. This is effected by a locking mechanism. The locking mechanism comprises a cam plate and two spring biased pawls carried by a visor arm. The pawls engage the cam to lock the visor in the required position.

This mechanism involving, as it does, a lot of moving parts, is complex and expensive to produce.

SUMMARY OF THE INVENTION

One object of the present invention is to provide a helmet having an improved visor operating mechanism.

The present consists in a helmet having a visor rotatably mounted on pivot mean secured to the helmet and a visor displacement and latching mechanism for rotatably moving said visor between a lowered operative and a raised retracted position thereof, said mechanism comprising an operating lever which is rotatably mounted in relation to the visor pivot means and is also rotatable on a further pivot means secured to the visor and offset from said visor pivot means; cooperating latching elements respectively provided on the lever and immovably, fixed in relation to the helmet which engage and disengage upon rotation of the lever, in opposite senses, about the further pivot means, when said visor is disposed in the operative or retracted position; and cooperating visor driving elements respectively provided on the lever and immovably fixed in relation to the helmet, which upon rotation of the lever about the visor pivot means, with said latching elements disengaged, cooperate to effect rotation of the visor from one to the other of the operative and retracted positions.

Preferably the cooperating latching elements comprise two angularly spaced pairs of cooperating latching elements, said pairs respectively serving to latch the visor in the operative and returned positions thereof.

Also preferably the cooperating visor driving elements comprise two angularly spaced pairs of cooperating visor driving elements.

Advantageously the elements of the pairs of the latching and visor driving elements which are immovably fixed in relation to the helmet are arranged with the latching elements adjacent respective of the visor driving elements so that as the lever is rotated to the point where it locates the visor in one of said operative or retracted positions by engagement of one pair of the cooperating visor driving elements, the latching element, adjacent the visor driving element which is secured to the helmet and is not engaged with its cooperating element, is engaged with its cooperating latching element.

Also advantageously two visors are rotatably mounted on the helmet on coaxial visor pivot means at opposite sides of the helmet, said visor displacement and latching mechanisms being provided at each side of the helmet for the respective visors, and each visor being freely pivoted at the side of the helmet opposite the visor displacement and latching mechanism thereof on the visor pivot means.

BRIEF DESCRIPTION OF THE DRAWINGS

The invention will now be described, by way of example only, with reference to the accompanying drawings, in which.

DETAILED DESCRIPTION OF THE INVENTION

Figure 1:
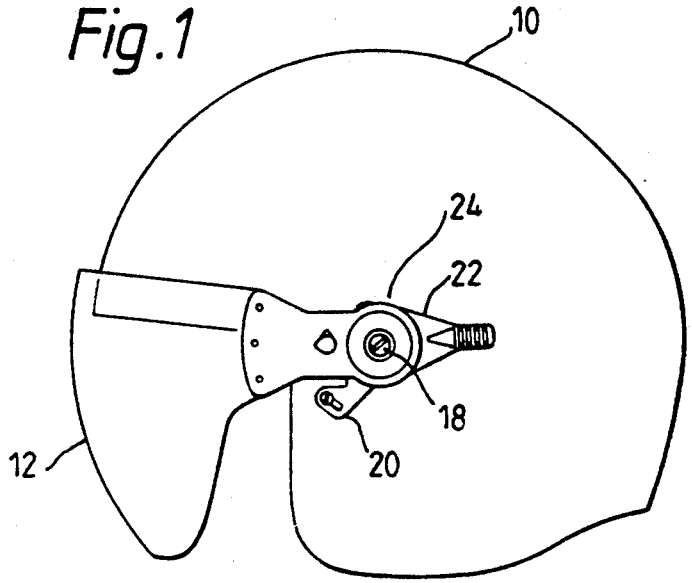
FIG. 1 is a side view of a helmet with a visor in an operative position.
Figure 2:
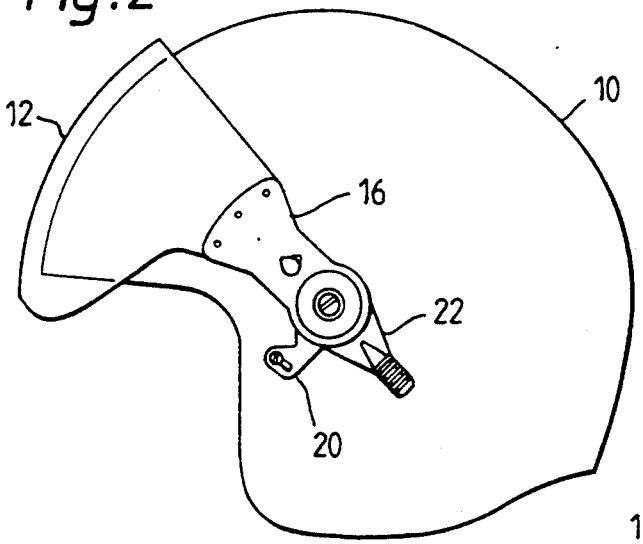
FIG. 2 is a side view of the helmet of FIG. 1 with the visor in an intermediate position.
Figure 3:
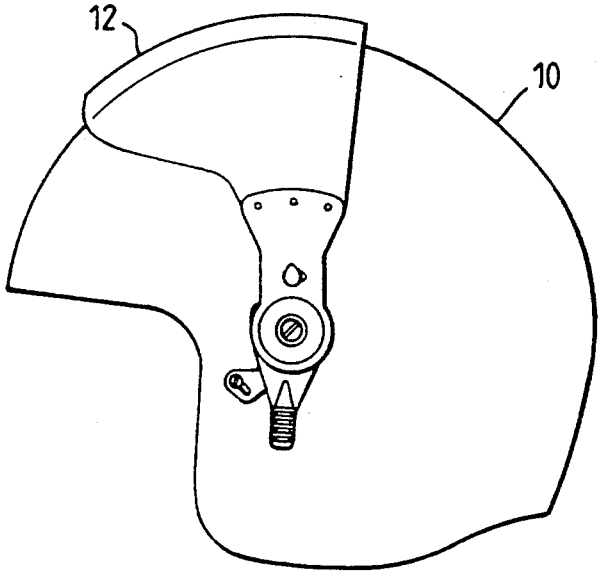
FIG. 3 is a side view of the helmet of FIGS. 1 and 2 showing the visor in a completely retracted position.

In the drawings like parts are given the same reference numerals.

Figure 4:
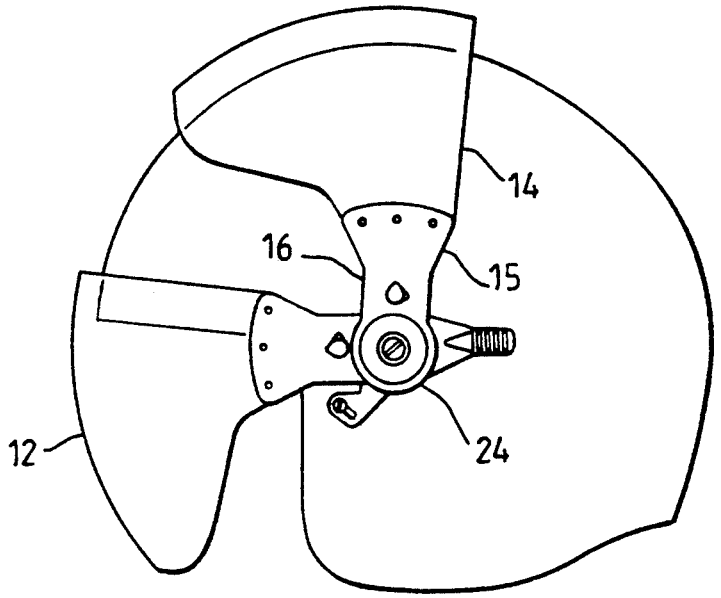
FIG. 4 is a side view of a helmet showing two visors, one in an operative position, one in retracted position.
Figure 5A:
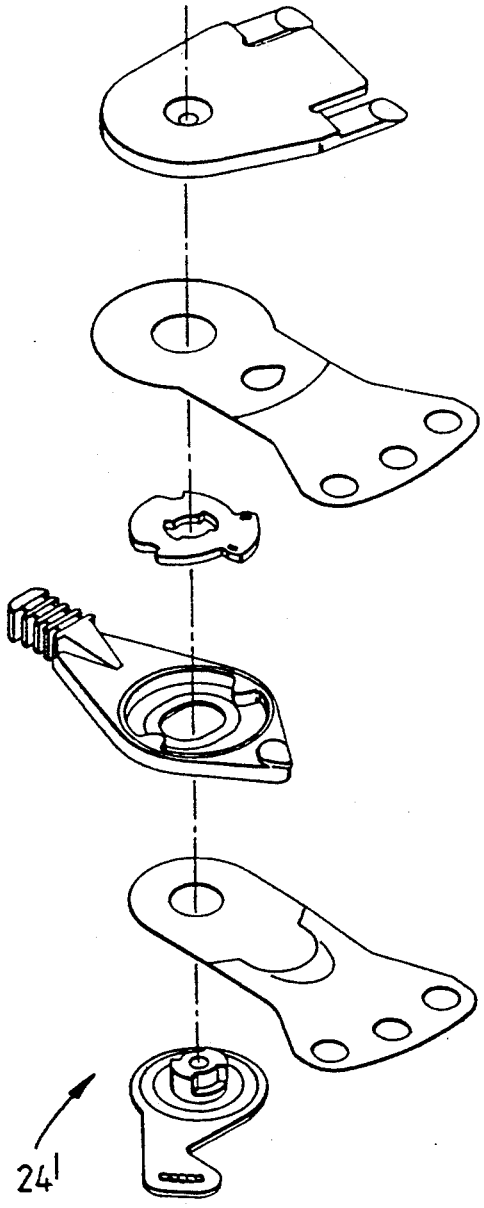
FIGS. 5*a* and 5*b* are exploded views of a visor mechanism according to the present invention.
Figure 5B:
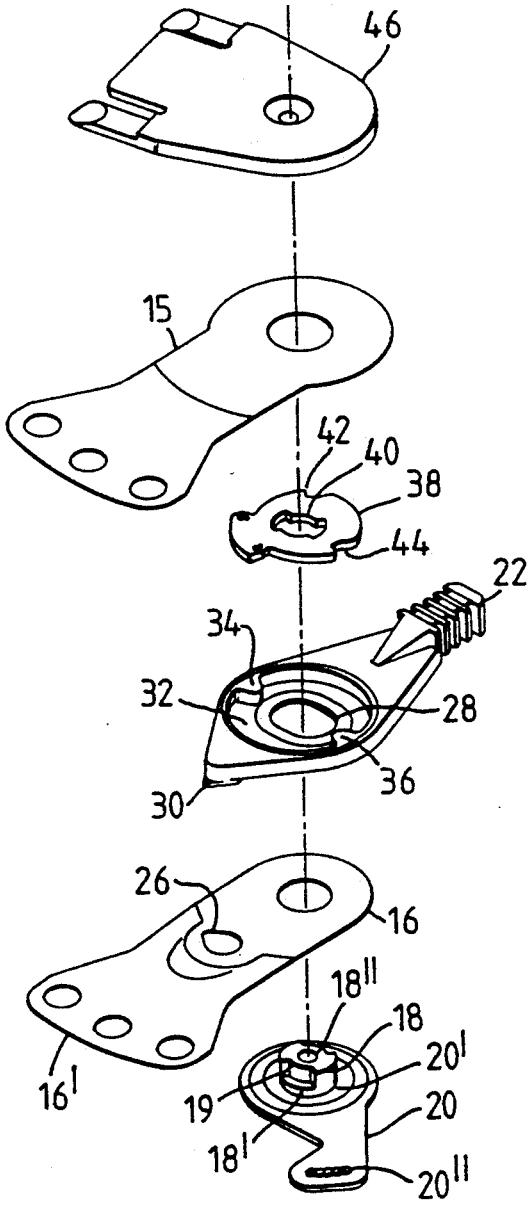

Referring to the figures, a helmet shown generally at (10) is provided with a first visor (12). A second visor (14) as shown in FIG. 4 may further be provided. The first visor (12) is pivotably mounted to the helmet by means of an arm (16) which is mounted on a pivot post (18), and the second visor (14) is pivotally mounted on the helmet by means of an arm (15) also mounted on the pivot post. The pivot post extends from a plate (20) which is rigidly fixed to the side of the helmet in any known manner. It is preferred that the plate (20) should be secured at two points namely (20') and (20'') as shown in FIG. 5. The double point mounting protects the shell of the helmet, imposing less stress when the visor is moved by means of a lever (22). The lever (22) forms part of a visor displacement and latching mechanism shown generally at (24).

The visor displacement and latching mechanism (24) includes the plate (20) and upstanding pivot post (18). The pivot post has a circular cross-section inner part (18') and a keyed part (18''). The keyed part includes two keying tracks (19). Arm (16) of the visor (12) is pivotally mounted on the pivot post. The visor is attached to the arm by means of any appropriate attachment at end (16') of the arm. The arm also includes an elongated aperture (26), the function of which is referred to below.

The lever (22) is mounted atop arm (16) on the pivot post (18), the post (18) passing through an aperture (28) in the lever so that lever is rotatable in relation to the post. The lever (22) is also pivotally mounted with respect to the arm (16). This further pivotal mounting is effected by a projection (30) which is received in the aperture (26) on the arm (16).

The aperture (28) in the lever (22) is somewhat elongated to allow the lever to move relative to the pivot post (18) as the lever pivots on the arm (16). The lever further includes a hollowed out portion (32) into which project two teeth or projections (34) and (36).

A profiled cam (38) is received within the hollowed out portion (32) of the lever (22). The cam is keyed on the key tracks (19) of the pivot post (18), so as to be immovably fixed to the plate (20). The cam includes two recesses (42) and (44) which are shaped to receive teeth (34) and (36) respectively.

The second visor arm (15) associated with the second visor is also pivotally mounted on the pivot arm above the lever. The above described elements are all held mounted on the pivot post (18) by any appropriate means, for example by a fixing plate (46).

Figure 6:
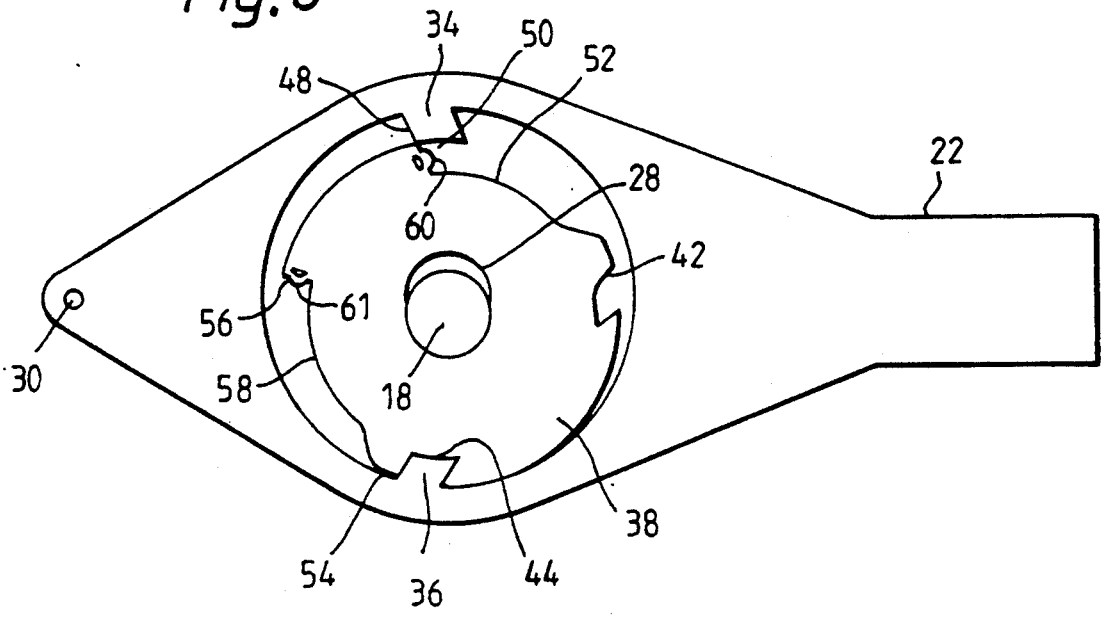
FIG. 6 is a diagram for showing the operation of the visor mechanism.

Referring to FIG. 6, the lever (22) and the cam (38) are shown in more detail, with the lever (22) in the position it occupies when the first visor is in the operative position. Tooth (36) and recess (44) form cooperating latching elements. Tooth (36) is located within recess (44) to hold the visor arm (16) against rotation in relation to the helmet shell.

To move the first visor from this position, i.e. the operative position to the retracted position the helmet wearer moves lever (22). Initial movement of the lever in the clockwise direction causes the lever to pivot relative to the visor arm (16), about pivot point (30). This causes the tooth (36) to move out of engagement with the recess (44), thereby disengaging the latching elements. Rotation of the lever (22) relative to visor arm (16) continues until the tooth (34) moves into engagement with profiled surface (52). Further movement of lever (22) causes the lever to rotate about pivot post (18), and to apply a turning moment to the visor arm (16), through engagement of the cooperating visor driving elements, namely the tooth (34) and profiled surface (52) of the cam, and engagement of lever (22) with arm (16) at pivot point (30).

The visor arm (16) is therefore rotated with the lever (22), to move the visor upwards towards its retracted position. During this rotation, the tooth (34) slides along the cam surface (52), and is moved radially outwards by the increasing radius of the surface (52), until the tooth (34) reaches the recess (42). At this point, the other tooth (36), which has been moved inwards for engagement with the profiled surface (58) of the cam, engages an inwardly directed face (56) on the cam. This engagement prevents further rotation of the visor arm (16), so that continued movement of the lever (22) causes the lever to rotate about pivot point (30) to move the tooth (34) into engagement with the recess (42). The visor arm (16) is now held against rotation by the latching engagement of tooth (34) in recess (42), so holding the visor latched in the retracted position.

As the tooth (34) moves into engagement with the recess (42), the other tooth (36) moves radially outwards. A compliant projection (61) is located on face (56) of the cam which is engaged by the tooth (36) just before the tooth (34) is aligned with the recess (42). The compliance of the projection (61) is provided by a slit (62) in the cam adjacent the projection. The compliant projection (61) is compressed by the tooth (36) as the tooth (34) is moved into the recess (42). As the tooth (36) moves radially outwards it becomes disengaged from the compliant projection. The tooth (36) must overcome the compliance of the projection before it can be moved radially inwards to disengage the tooth (34) from recess (42) to allow the visor to be moved from its retracted position. The compliant projection reduces the likelihood of inadvertent movement of the visor.

When the helmet wearer wishes to move the visor from the retracted to the operative position the lever (22) is rotated in an anti-clockwise direction, to disengage tooth (34) from recess (42). Further rotation of the lever causes tooth (36) to engage and slide along profiled surface (58) until the tooth (34) engages inwardly directing face (50) of the cam, and tooth (36) is reseated in recess (44). The face (50) has a compliant projection (60) which provides a stop against tooth (34) in an anti-clockwise direction of movement of the lever (22) whilst recess (44) is engaged by tooth (36). Likewise compliant projection (61) on the face (56) of the cam is engaged by tooth (36) to prevent further clockwise rotation of lever (22) whilst tooth (34) engages cam recess (42).

It is preferred that the projections (34) and (36) also have a degree of compliance to allow the cooperation between faces (50) and (56) to be a relatively tight fit with the projection extending slightly into a gap beyond each face (50) and (56).

When two visors are used on the same helmet, each may have its own visor displacement and latching mechanism. For example, visor (12) will have visor displacement and latching mechanism (24) on the left-hand side of the helmet, whilst visor (14) will have a similar visor displacement and latching mechanism (24') on the right-hand side of the helmet. The only difference between these two mechanisms (24) and (24') is the relative positions of the elements making up the mechanism. Each visor is also pivotally mounted on the pivot post (18) at the side of the helmet opposite that at which the visor displacement and latching mechanism is provided.

The mechanism can be axially loaded by means of a spring washer (not shown) to provide frictional location of the visor between the operative and retracted positions.

It should be noted that the lever need not be rotatably mounted directly on the visor pivot post, but only needs to be rotatable relatively to that post.

It will be appreciated that additional visors may be provided on the helmet, each additional visor having a latching mechanism in accordance with the invention, or a more conventional latching mechanism.

I claim:

1. A helmet having a visor rotatably mounted on pivot means secured to the helmet and a visor displacement and latching mechanism for rotatably moving said visor between a lowered operative and a raised retracted position thereof, said mechanism comprising an operating lever which is rotatably mounted in relation to the visor pivot means and is also rotatable on a further pivot means secured to the visor and offset from said visor pivot means; first visor latching means for effecting latching engagement between the lever and the helmet to prevent rotation of the lever and the visor about the visor pivot means when the visor is in the operative position, said visor latching means being engageable and disengageable upon rotation of the lever, in opposite senses, about the further pivot means, when said visor is disposed in the operative position; a second visor latching means for effecting latching engagement between the lever and the helmet to prevent rotation of the lever and the visor about the visor pivot means when the visor is in the retracted position, said visor latching means being engageable and disengageable upon rotation of the lever, in opposite senses, about the further pivot means, when said visor is disposed in the retracted position; and visor driving means for effecting rotation of the visor from one to the other of the operative and retracted positions upon rotation of the lever about the visor pivot means, with said first and second visor latching means disengaged.

2. A helmet according to claim 1, wherein said first visor latching means comprises a first pair of co-operating latching elements, one provided on the lever and the other being fixed in relation to the helmet, which engage and disengage upon rotation of the lever, in opposite senses, about the further pivot means, when said visor is disposed in the operative position and said second visor latching means comprises a second pair of cooperating latching elements, one provided on the lever and the other being fixed in relation to the helmet, which engage and disengage upon rotation of the lever, in opposite senses, when said visor is disposed in the retracted position.

3. A helmet according to claim 2, wherein the two pairs of cooperating latching elements are angularly spaced about such pivot means.

4. A helmet according to claim 2, in which the visor driving means comprises first and second pairs of cooperating visor driving elements, one of each pair being provided by a respective one of said latching elements on the lever and the other being immovably fixed in relation to the helmet, the driving elements upon rotation of the lever about the visor pivot means, with said latching elements disengaged, cooperating to effect rotation of the visor from one to the other of the operative and retracted positions.

5. A helmet as claimed in claim 4, wherein the elements of the pairs of latching and visor driving elements provided on the lever are immovably secured to said lever.

6. A helmet as claimed in claim 4, wherein two visors are rotatably mounted on the helmet on coaxial visor pivot means at opposite sides of the helmet, said visor displacement and latching mechanisms being provided at each side of the helmet for the respective visors and each visor being freely pivoted at the side of the helmet opposite the visor displacement and latching mechanism thereof on the visor pivot means.

7. A helmet according to claim 4, wherein the elements of the pairs of the latching and visor driving elements which are immovably fixed in relation to the helmet are arranged with the latching elements adjacent respective of the visor driving elements so that as the lever is rotated to the point where it locates the visor in one of said operative or retracted positions by engagement of one pair of the cooperating visor driving elements, the latching element, adjacent the visor driving element which is secured to the helmet and is not engaged with its cooperating element, is engaged with its cooperating latching element.

8. A helmet according to claim 7, wherein the elements of the pairs of the latching and visor driving elements which are secured to the helmet are provided on a profile of a cam secured immovably to the helmet.

9. A helmet as claimed in claim 8, wherein the elements of the visor driving elements which are secured to the helmet comprise angularly spaced arcuate sections of said cam profile and the latching elements on the profile comprise respective recesses respectively adjoining said arcuate profile sections.

10. A helmet as claimed in claim 9, wherein the elements of the pairs of latching elements provided on the lever comprise respective tooth projections arcuately spaced apart.

11. A helmet according to claim 10, wherein each tooth projection has an inwardly directed face which engages an inwardly directed face on the cam as the other tooth projection is moved into alignment with its respective recess.

12. A helmet according to claim 11, wherein the inwardly directed face of the cam has a compliant projection which is compressed by the inwardly directed face of the tooth projection engaging the inwardly directed face of the cam as the other tooth projection is moved out of engagement with its respective recess, to inhibit inadvertent release of the latching engagement of the other tooth projection in the recess.

* * * * *